US010677529B2

(12) United States Patent
Pirie et al.

(10) Patent No.: US 10,677,529 B2
(45) Date of Patent: Jun. 9, 2020

(54) VACUUM FORMING METHOD

(71) Applicant: Ducommun Aerostructures, Inc., Carson, CA (US)

(72) Inventors: Andrew Pirie, Gardena, CA (US); Ignacio Hernandez, Gardena, CA (US)

(73) Assignee: DUCOMMUN AEROSTRUCTURES, INC., Carson, CA (US)

( * ) Notice: Subject to any disclaimer, the term of this patent is extended or adjusted under 35 U.S.C. 154(b) by 283 days.

(21) Appl. No.: 15/624,524

(22) Filed: Jun. 15, 2017

(65) Prior Publication Data

US 2017/0363355 A1 Dec. 21, 2017

Related U.S. Application Data

(60) Provisional application No. 62/350,559, filed on Jun. 15, 2016.

(51) Int. Cl.

| | |
|---|---|
| ***B21D 5/02*** | (2006.01) |
| ***B21D 11/20*** | (2006.01) |
| ***B21D 53/92*** | (2006.01) |
| ***C21D 1/30*** | (2006.01) |
| ***F27D 7/06*** | (2006.01) |
| ***F27D 5/00*** | (2006.01) |

(Continued)

(52) U.S. Cl.

CPC ..... *F27D 7/06* (2013.01); *B21D 5/02* (2013.01); *B21D 11/203* (2013.01); *B21D 53/92* (2013.01); *C21D 1/30* (2013.01); *C22F 1/02* (2013.01); *C22F 1/183* (2013.01); *F27D 5/00* (2013.01); *F27D 5/0006* (2013.01); *F27D 2007/066* (2013.01)

(58) Field of Classification Search

CPC ..... B21D 5/02; B21D 11/203; B21D 53/92; C21D 1/30; F27D 7/06; C22F 1/02; C22F 1/183

See application file for complete search history.

(56) References Cited

U.S. PATENT DOCUMENTS

| | | | |
|---|---|---|---|
| 2,959,843 | A | 11/1960 | Uitvlugt |
| 2004/0221929 | A1 | 11/2004 | Hebda et al. |
| 2013/0037183 | A1 | 2/2013 | Daffos et al. |

FOREIGN PATENT DOCUMENTS

| | | | |
|---|---|---|---|
| CN | 102335754 | A | 2/2012 |
| CN | 105839039 | A | 8/2017 |

OTHER PUBLICATIONS

Machine translation of CN102335754, Jiangang et al., translated on Jun. 20, 2019, pp. 1-9. (Year: 2019).*

(Continued)

*Primary Examiner* — Teresa M Ekiert

(74) *Attorney, Agent, or Firm* — Angela Holt; Bradley Arant Boult Cummings LLP

(57) ABSTRACT

A method for forming large titanium parts includes forming bends into a titanium plate for form a bent part. The bent part is then roll-formed to form contours into the bent part. The surfaces of the contoured part are rough-machined, and the part is then secured to a bladed form fixture. The bladed form fixture comprises a plurality of header boards that secure the part to the fixture. The fixture part is placed in a thermal vacuum furnace and a stress-relieving operation is performed. The part is removed from the fixture and final machining takes place.

18 Claims, 6 Drawing Sheets

(51) Int. Cl.
*C22F 1/02* (2006.01)
*C22F 1/18* (2006.01)

(56) References Cited

OTHER PUBLICATIONS

International Search Report and Written Opinion for International application No. PCT/US17/37774.

* cited by examiner

VACUUM FORMING METHOD

REFERENCE TO RELATED APPLICATIONS

This application claims priority to Provisional Patent Application U.S. Ser. No. 62/350,559, entitled "Vacuum Forming Method" and filed on Jun. 15, 2016, which is fully incorporated herein by reference.

BACKGROUND AND SUMMARY

Forming large titanium parts has typically been done using a large heated press and matched die tooling. When parts to be formed are large (i.e., larger than 96 inches long), the die tooling is very expensive. The titanium itself is also very expensive, and current methods for forming large parts generally require relatively thick plates of titanium be used. For example, in the aircraft industry, titanium plates of up to 2.5 inches in thickness may be required to form a part with a final thickness of less than three quarter inches.

Further, current methods of fabricating large titanium parts typically require multiple machining operations and multiple stress relief procedures to avoid machining-induced stress or machining-released stresses that result in distortion of the end product. The multiple machining operations and multiple stress relieving procedures add many hours and much cost to the manufacturing process.

A method for forming large titanium parts according to the present disclosure allows large titanium parts to be formed from thin plates of titanium (0.75 inches thick, in one embodiment), and requires only one vacuum furnace sizing operation. In the preceding sentence, "thin" refers to plates with thicknesses significantly closer to the max thickness of the final product when compared to forgings and or hog outs from larger plates where the part form is machined into the part instead of formed into the part.

Using the method according to the present disclosure, a titanium plate is bent to form bends in the plate. The bent part is then roll-formed to form contours into the bent part. The surfaces of the contoured part are rough-machined, and the part is then secured to a bladed form fixture. The bladed form fixture comprises a plurality of header boards that secure the part to the fixture. The fixture part is placed in a thermal vacuum furnace and a stress-relieving operation is performed. The part is removed from the fixture and final machining is performed.

DETAILED DESCRIPTION

Figure 1:
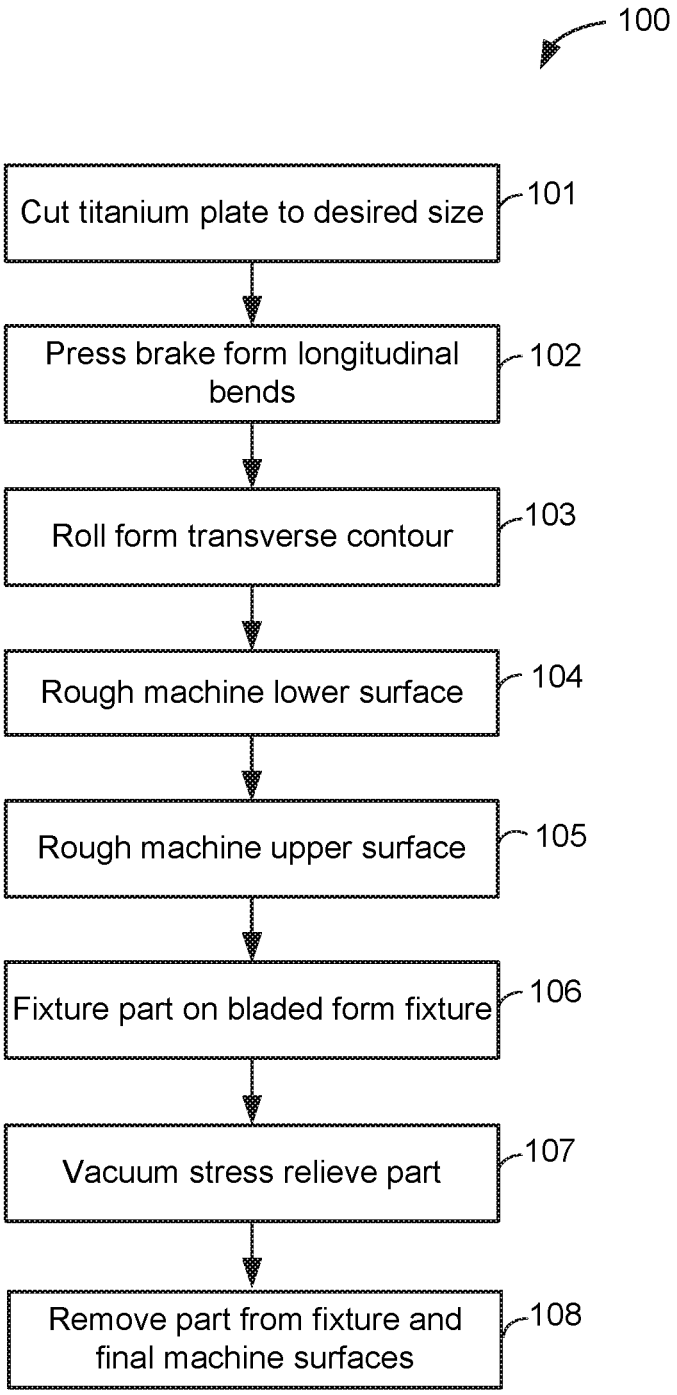
FIG. 1 is a flow chart depicting the steps in a method for forming large titanium parts according to an exemplary embodiment of the present disclosure.

FIG. 1 depicts a method 100 for forming titanium parts according to an exemplary embodiment of the present disclosure. In step 101 of the method 100, a titanium plate (not shown) is cut to the desired size part (not shown) using a method known in the art. For example, a waterjet operation may be used to cut the titanium to size.

Figure 2:
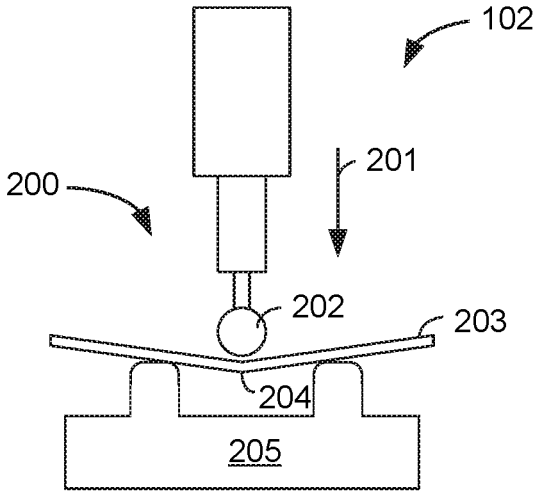
FIG. 2 depicts an exemplary step in which a press brake forms a "V"-shape extending longitudinally in a titanium part 203.

In step 102 of the method 100, a press brake is used to form bends in the pattern blank. FIG. 2 depicts an exemplary step 102, in which a press brake 200 forming a "V"-shape 204 extending longitudinally in a titanium part 203. In this step, the part 203 rests atop a die 205 while an upper tool 202 presses down on the part 203, in the direction indicated by directional arrow 201. In one embodiment, a warm brake-forming operation is utilized on a 42' 1250 ton brake. The part 203 is heated to approximately 850° F. and the angle is formed with the part above 600° F.

In a traditional manner of forming large titanium parts, a custom die is used to hot-form the part to a "near-net" shape. Step 102 of the method according to the present disclosure uses a "V-die" that does not adhere to the near-net shape, saving significant tooling costs.

Figure 3:
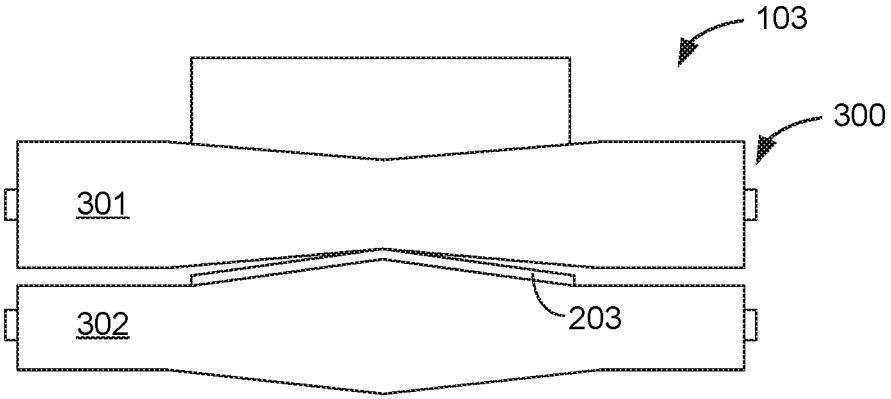
FIG. 3 depicts a roll-forming operation according to an exemplary embodiment of of the method.
Figure 4A:
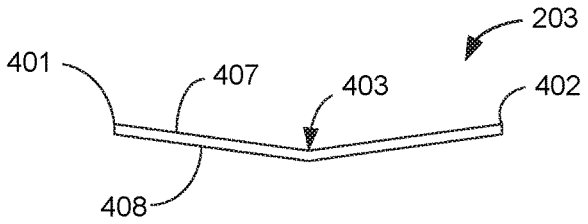
FIG. 4*a* is an end edge view of the part after the roll-forming step has been completed.
Figure 4B:
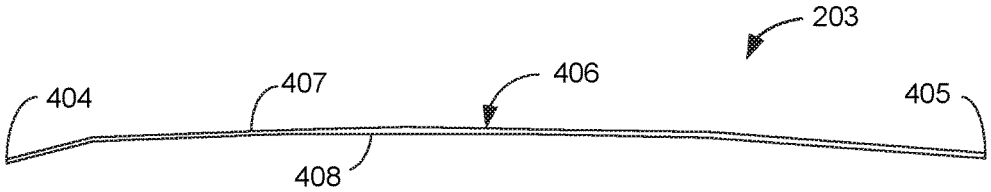
FIG. 4*b* is a side edge view of the part after the roll-forming step has been completed.

In step 103 of the method 100, contours in the part are roll-formed. FIG. 3 depicts a roll-forming operation according to an exemplary embodiment of step 103 of the method 100 that forms the part 203 to a somewhat concave shape as illustrated in FIGS. 4*a* and 4*b*. In this step 103, a standard roll-forming machine 300 forms the part 203 with a plurality of rollers, including rollers 301 and 302, and a third roller (not shown). In one embodiment, the method 100 uses an SIHR 17/3 roll forming machine. Custom rollers will accommodate the V-shape of the part 203. Step 103 of the method is typically performed at room temperature.

FIG. 4*a* is an end edge view of the part 203 after step 103 has been completed. The part 203, which is exemplary of the type of part that can be formed using this method 100, comprises opposed long side edges 401 and 402 and a central "V" 403 that extends longitudinally down the part 203. In the illustrated embodiment, the part 203 is generally symmetrical about its longitudinal axis (not shown). The part 203 further comprises an upper surface 407 and a lower surface 408.

FIG. 4*b* is a side edge view of the part 203 after step 103 has been completed. The part 203 comprises the upper surface 407, the lower surface 408, opposed short edges 404 and 405, and a center portion 406 that curves upwardly from the opposed short edges 404 and 405.

In step 104 of the method 100, the lower surface 408 of the part 203 is rough-machined on a first fixture (not shown). The rough-machining step establishes coordination and minor rough machining of the lower surface 408 of the part. Coordination tooling holes (not shown) will be drilled during this step, holes that will be used to locate the parts throughout the machining fixture forming process.

In step 105 of the method 100, after the lower surface 408 of the part is rough-machined, the part is flipped over and secured to a second fixture (not shown). The tooling holes drilled in step 104 establish the location for securing the part to the second fixture. The upper surface 407 is then rough-machined leaving a target clean-up of 0.100" over the entire surface.

In step 106 of the method 100, the part 203 is fixtured and restrained on a bladed form fixture. The fixture is designed force the part (not shown) to the nominal lower surface of the fixture, offset for the known excess material thickness.

Figure 5:
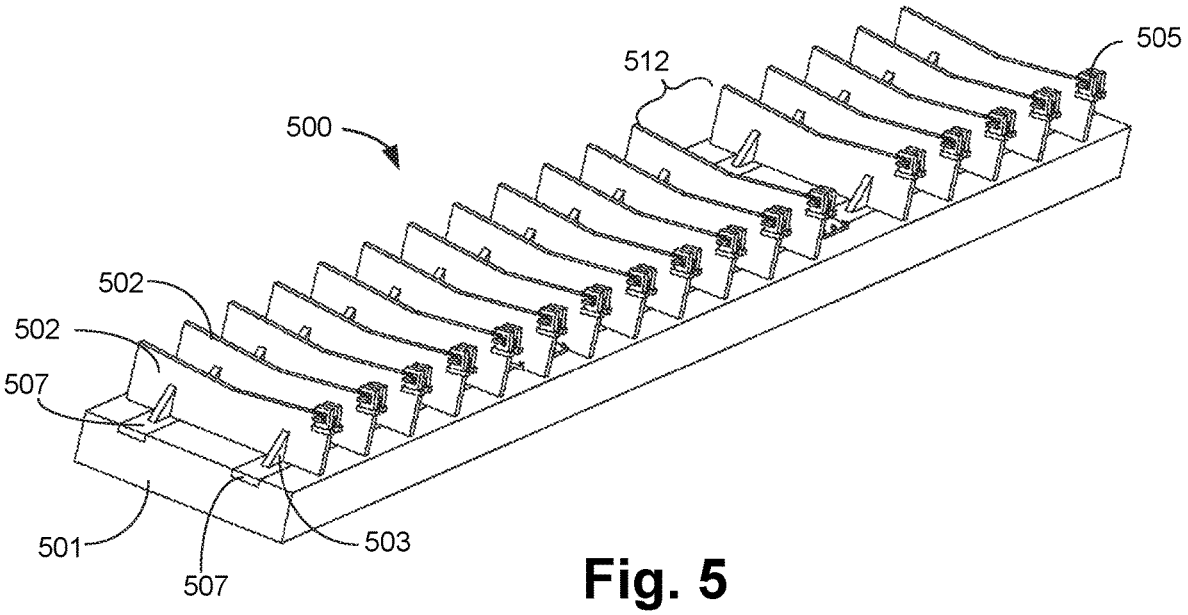
FIG. 5 is a perspective view of a bladed form fixture according to an exemplary embodiment of the present disclosure.

FIG. 5 is a perspective view of a bladed form fixture 500 used in step 106, according to an exemplary embodiment of the present disclosure. The fixture 500 comprises a generally rectangular base 501 and a plurality of header boards 502 (i.e., blades) extending upwardly from the base 501. The header boards 502 are spaced apart from one another, and each header board 502 has a top edge that is dimensioned to conform to the lower surface 408 (FIGS. 4*a* and 4*b*) of the part 203.

In one embodiment the header boards 502 are formed from titanium that is 0.90 inches thick and are secured to runners 507 that extend longitudinally down the base 501. The fixture 500 comprises two (2) runners 507 spaced transversely-apart from one another in the illustrated embodiment. The runners 507 are formed of 1.0" thick titanium in one embodiment, but may be other thicknesses in other embodiments. Further, the runners 507 may be formed from some other suitably strong material, provided that the material has a thermal expansion rate substantially similar to that of the titanium part 203. The runners 507 are inset into the base 501. The base 501 is formed from 3.5 inches thick cast stainless strong back egg crate material in one embodiment.

Gussets 503 on opposed sides of the header boards 502 support the headers boards 502 on the runners 507, as further discussed herein.

In one embodiment, the header boards 502 are spaced about ten inches from one another. In this embodiment, the part 203 is approximately 224 inches, such that with a ten-inch spacing, the spacing of the header boards apart from one another is between 4 and 5% of the overall length of the part 203. A spacing range between header boards of between 3-7% of the total length of the part produces good retention of the part with the fixture in one embodiment.

In other embodiments, the header boards 502 may be differently-spaced, provided, however, that the spacing should be sufficiently close together that the part 203 is sufficiently constrained to the fixture 500. Note that FIG. 5 shows a gap 512 between header boards 502 where the header boards are not equidistantly spaced. In some embodiments, the header boards are equidistantly spaced. In other embodiments, there are gaps 512 to accommodate restraint plates (not shown) that are further discussed with respect to FIGS. 10 and 11 herein.

Clamps 505 are disposed on opposed edges of the header boards 502 and secure the part (not shown) to the top outer edges of the header boards 502. Although FIG. 5 does not show clamps 505 on both transverse edges of the header boards 502, or on all of the header boards 502, clamps 505 would generally be used on every outside edge of each header board.

Figure 6:
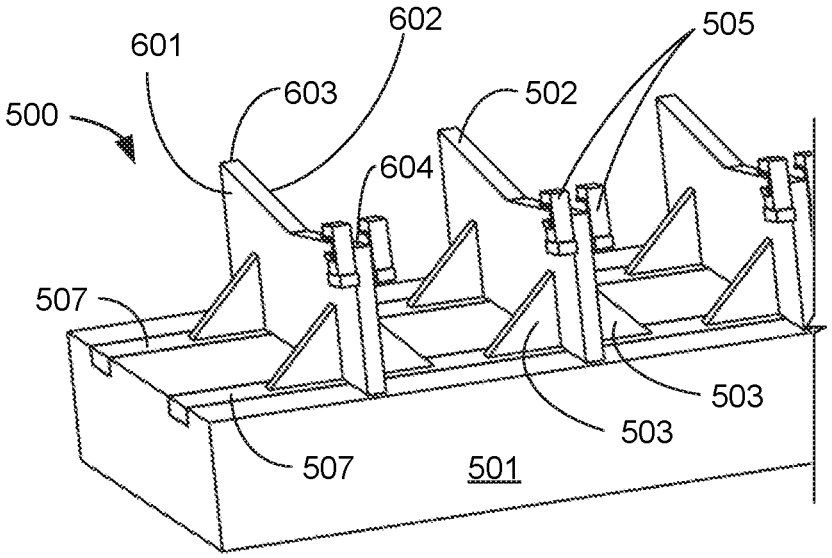
FIG. 6 is an enlarged partial perspective view of the bladed form fixture of FIG. 5.

FIG. 6 is an enlarged partial perspective view of the fixture 500 of FIG. 5. In the illustrated embodiment, a clamp 505 is disposed on opposed sides (a front side 601 and a back side 602) of each upper corner (a left upper corner 603 and a right upper corner 604) of each header board 502. (Note that FIG. 6 does not show clamps 505 on the left upper corner 603; however, in practice, clamps 505 will generally be disposed on each upper corner 603 and 604 of each header board 502.)

Figure 7:
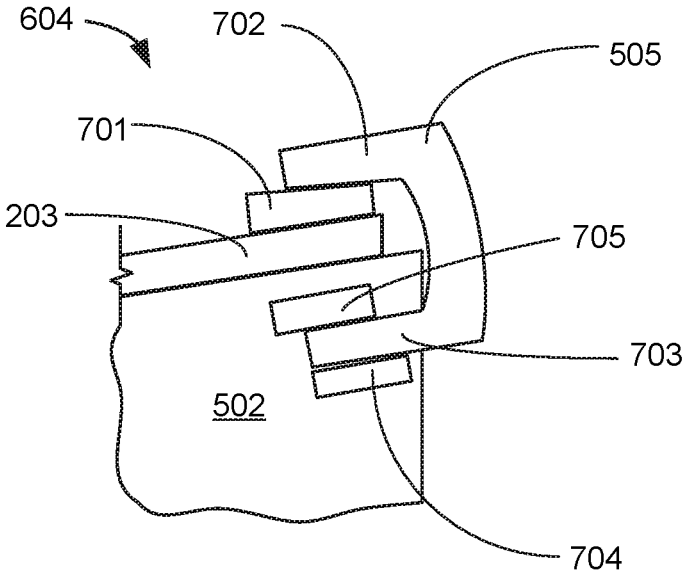
FIG. 7 is an enlarged partial front view of an upper right corner of a header board of the bladed form fixture.

FIG. 7 is an enlarged partial front view of an upper right corner 604 of a header board 502 of the fixture 500. The clamp 505 comprises a C-shaped clamp that extends around the part 203 to hold it firmly to the header board 502. A wedge 701, which is formed from stainless steel in one embodiment, is disposed between an upper leg 702 of the clamp 505 and the part 203. A lower leg 703 of the clamp 505 is supported by an upper guide 705 and a lower guide 704. The upper guide 705 and the lower guide 704 are welded to the header board 502. The lower leg 703 of the clamp 505 is received between the guides 705 and 704. When tightened, the clamp 505 puts pressure on the upper guide 705 and the wedge 701 to force the part 203 in close contact with the header board 502.

Figure 8:
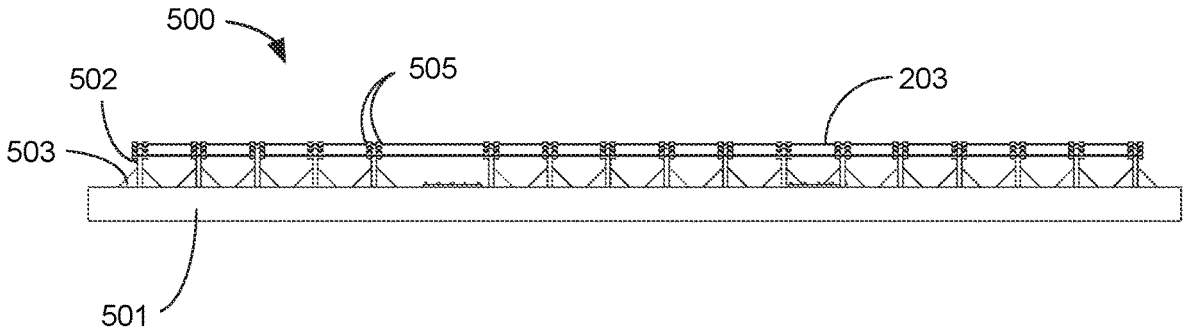
FIG. 8 is side view of the fixture of FIG. 5 with the part clamped to the header boards.

FIG. 8 is side view of the fixture 500 of FIG. 5 with the part 203 clamped to the header boards 502. Note that while the top surface of the part 203 appears as substantially flat in this figure, the part 203 may be curved as shown in FIG. 4*b* and as further discussed herein. The header boards 502 are dimensioned to "follow" the shape of the lower surface of the finished part 203. The base 501 is sized to be slightly longer than the part 203. Clamps 505 are generally used in each upper corner of each header board 502, as discussed above.

Figure 9:
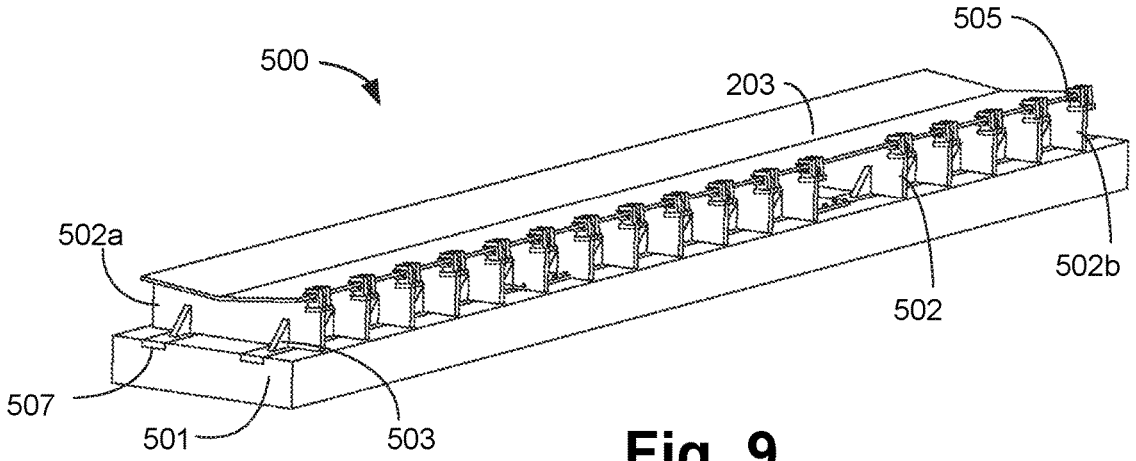
FIG. 9 is a perspective view of the part in the fixture of FIG. 8
Figure 13:
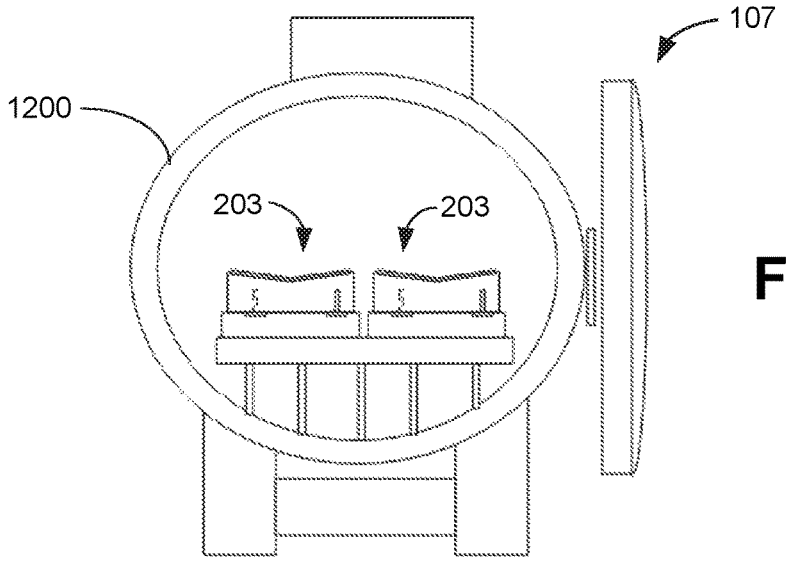
FIG. 13 depicts the vacuum furnace stress relieving step of the method according to an exemplary embodiment of the present disclosure.

FIG. 9 is a perspective view of the part 203 in the fixture 500 of FIG. 8. The opposed long edges of the part 203 generally extend to the opposed side edges of the header boards 502, as shown. Further, the opposed short edges of the part 203 generally extend between a first header board 502*a* and a last header board 502*b*.

Figure 10:
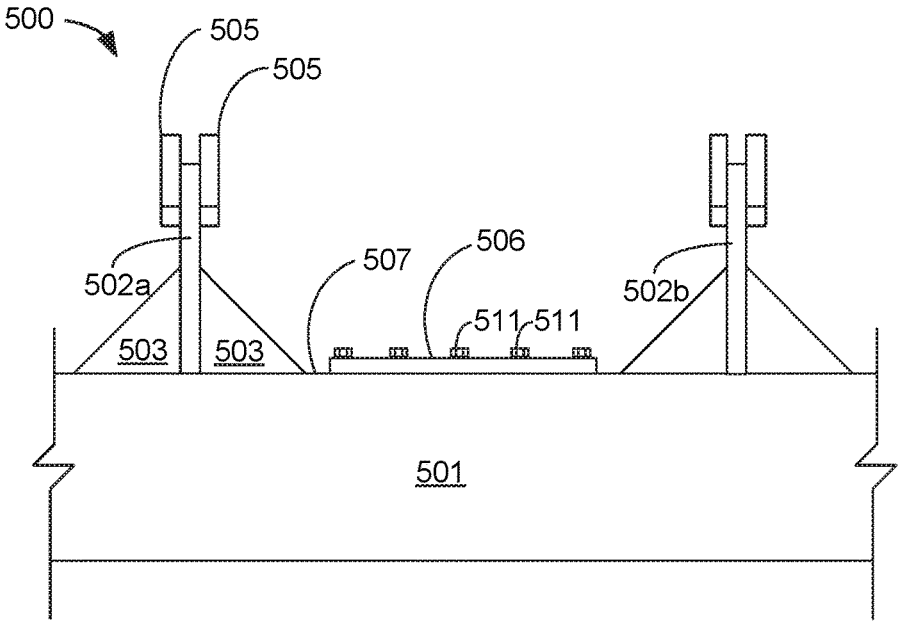
FIG. 10 is an enlarged side plan view of the fixture of FIG. 8.

FIG. 10 is an enlarged side plan view of the fixture 500 of FIG. 8 without the part installed. The runners 507, which are inset into the base 501, are formed from 1 inch thick titanium in one embodiment. Titanium is used for the runners because it will expand and contract substantially the same as the part 203 (FIG. 8). A plurality of restraint plates 506 affix the runners 507 to the base 501 without constraining the expansion and contraction of the runners 507 during vacuum thermal cycling (of step 107 (FIG. 1), as discussed herein with respect to FIG. 12). In this regard, the restraint plates 506 fit over the runners 507 and extend beyond the long edges of the runners, and are secured directly to the base 501 with a plurality of fasteners 511.

Figure 11:
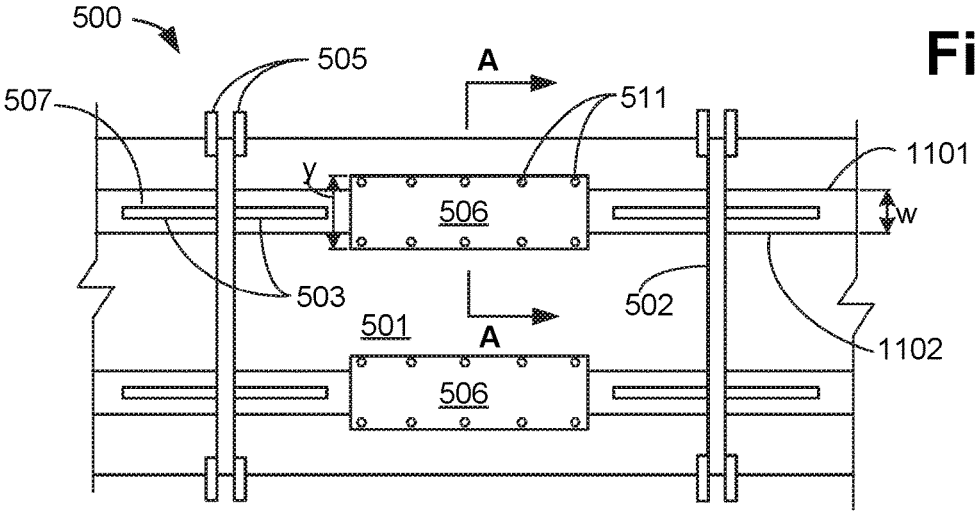
FIG. 11 is a top view of the fixture of FIG. 10

FIG. 11 is a top view of the fixture 500 of FIG. 10. The restraint plates 506 are sized such that it has a width "y" that is wider than a width "w" of the runner boards 507. Further the fasteners 511 that secure the restraint plates to the base 501 are located outside of the footprint of the runners 507 (i.e., outside of the width "w"). The gussets 503 affix the header boards 502 to the runners 507, via standard fasteners (not shown). This configuration allows the runners 507 to be retained to the base 501 in the vertical direction by the pressure of the restraint plates 511 above the runners 507, but because the restraint plates 511 are not fastened directly to the runners 507, the runners 507 are free to expand and contract longitudinally with the header boards 502 during thermal cycling and not be constrained by a base 501 that has a different thermal expansion profile.

Typical fixtures used to support titanium parts during thermal cycling are made from nickel alloy. Because nickel alloy expands and contracts at a different rate than titanium does, the thermal cycling time is required to be longer with nickel alloy fixturing of titanium parts. Further, the difference in thermal expansion between the dissimilar metals puts potentially-harmful stress on the titanium part. The fixture 500 of the present disclosure solves the problems of different thermal expansion rates inherent in most fixturing for titanium parts that causes internal stress or unintended part distortion. Restraint plates 506 are generally located at both ends of the base 501, and at one or more locations inwardly of the ends of the base 501.

Figure 12:
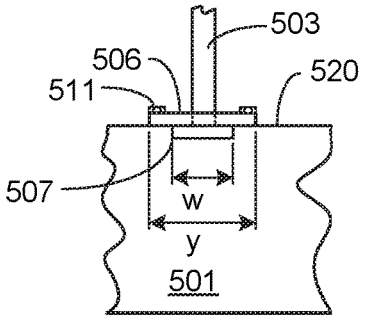
FIG. 12 is a cross-sectional view of an exemplary runner and restraint plate on the fixture base, taken along section lines A-A of FIG. 11.

FIG. 12 is a cross-sectional view of an exemplary restraint plate 506 and runner 507 on the base 501, taken along section lines A-A of FIG. 11. The runner 507 is recessed within a top surface 520 of the base 501. The restraint plate 506 is fixed to the top surface 520 of the base 501 via the fasteners 511. The gusset 503 is affixed to the runner 507 as discussed above. In FIG. 12, the gusset 503 may appear to be connected to the restraint plate 506, but is actually behind the restraint plate 506. The gussets 503 are not fastened to the restraint plates 506, because doing so could impede the expansion and contraction of the runner 507. Although the illustrated embodiment shows gussets 503 used to connect the header boards 502 to the runners 507, other means of connecting the header boards to the runners may be used in other embodiments.

Referring back to FIG. 1, in step 107 of the method 100, the fixtured part 203 is shuttled into a vacuum furnace for a vacuum stress relieving sizing operation. FIG. 12 depicts step 107 of the method 100. In the illustrated embodiment, a vacuum furnace 1200 receives two fixture parts 203 at once. Vacuum stress relieving after the rough machining steps (steps 104 and 105) serves to eliminate rough machining stresses. Temperature is cycled during step 107 as desired, and in some embodiments up to 1200 or 1250 degrees Fahrenheit.

In step 108 of the method 100, after the fixture part 203 is removed from the vacuum furnace 1200, the part is removed from the fixture 500 (FIG. 5) and the surface contour is verified by inspection. Final machining of the surfaces is then performed. During final machining, the part 203 is moved to a fixture (not shown) and its location is established by using the tooling holes drilled during the rough machining of step 104. The lower surface is then finish-machined with all machined features, and the finished features are inspected and verified.

Next the part 203 is moved and flipped onto another fixture for finial machining of the upper surface. The fixture for this operation ha sa full-contact surface where the finished lower surface will locate. All finished features are machined into the upper surface. Then the periphery of the part will be finish-machined to engineering requirements. All holes, including bushing holes, are bored to finished size. The finished features are then inspected and verified.

This disclosure may be provided in other specific forms and embodiments without departing from the essential characteristics as described herein. The embodiments described are to be considered in all aspects as illustrative only and not restrictive in any manner.

What is claimed is:

1. A method for forming large titanium parts, the method comprising:

forming bends into a titanium plate to form a bent part;

roll-forming contours into the bent part to form a contoured part;

rough-machining the surfaces of the contoured part to form a rough-machined part;

securing the rough-machined part to a bladed form fixture to form a fixtured part, the bladed form fixture comprising a plurality of header boards extending upwardly from a base, an upper surface of each of the header boards dimensioned to engage with a lower surface of the rough-machined part;

vacuum stress-relieving the fixtured part to form a stress-relieved part;

removing the stress-relieved part from the bladed form fixture;

final-machining the stress-relieved part.

2. The method of claim 1, wherein the plurality of header boards are spaced apart from one another substantially equidistantly.

3. The method of claim 2, wherein the plurality of header boards are spaced apart from one another a minimum distance of between 3 and 7% of a finished length of the part.

4. The method of claim 1, wherein the bladed form fixture further comprises a plurality of clamps engaged with upper corners of the header boards, each clamp configured to securely clamp the rough-machined part to one of the header boards.

5. The method of claim 4, wherein the plurality of clamps comprise C-clamps and each header board has a pair of the clamps on each opposed upper corner of the header board.

6. The method of claim 5, wherein one of the pair of clamps is disposed on a front side of the header board and one of the pair of clamps is disposed on a rear side of the header board.

7. The method of claim 1, wherein each header board is formed from titanium.

8. The method of claim 7, wherein each header board is connected to the base via titanium runners that extend longitudinally down the base.

9. The method of claim 8, wherein each runner is connected to the base via a restraint plate that extends over a width of the runner and is fastened to the base outside of the width of the runner, such that the runner is configured to expand and contract without being restrained longitudinally by the base.

10. A method for forming large titanium parts, the method comprising:

rough-machining the surfaces of a titanium part to form a rough-machined part;

securing the rough-machined part to a bladed form fixture to form a fixtured part, the bladed form fixture comprising a plurality of header boards extending upwardly from a base, an upper surface of each of the header boards dimensioned to engage with a lower surface of the rough-machined part;

vacuum stress-relieving the fixtured part to form a stress-relieved part;

removing the stress-relieved part from the bladed form fixture;

final-machining the stress-relieved part.

11. The method of claim 10, further comprising forming bends into the titanium part to form a bent part, before the bent part is rough-machined.

12. The method of claim 11, further comprising roll-forming contours into the bent part to form a contoured part, before the contoured part is rough-machined.

13. The method of claim 10, wherein the bladed form fixture further comprises a plurality of clamps engaged with upper corners of the header boards, each clamp configured to securely clamp the rough-machined part to one of the header boards.

14. The method of claim 13, wherein the plurality of clamps comprise C-clamps and each header board has a pair of the clamps on each opposed upper corner of the header board.

15. The method of claim 14, wherein one of the pair of clamps is disposed on a front side of the header board and one of the pair of clamps is disposed on a rear side of the header board.

16. The method of claim 10, wherein each header board is formed from titanium.

17. The method of claim 16, wherein each header board is connected to the base via titanium runners that extend longitudinally down the base.

18. The method of claim 17, wherein each runners is connected to the base via a restraint plate that extends over a width of the runner and is fastened to the base outside of the width of the runner, such that the runner is configured to expand and contract without being restrained longitudinally by the base.

* * * * *